US009879954B2

(12) United States Patent
Hajjar

(10) Patent No.: US 9,879,954 B2
(45) Date of Patent: Jan. 30, 2018

(54) LESS-LETHAL MUNITION AND MECHANICAL FIRING DEVICE

(71) Applicant: SNAKE RIVER MACHINE, INC., Meridian, ID (US)

(72) Inventor: Jeffrey Hajjar, Middleton, ID (US)

(73) Assignee: SNAKE RIVER MACHINE, INC., Meridian, ID (US)

( * ) Notice: Subject to any disclaimer, the term of this patent is extended or adjusted under 35 U.S.C. 154(b) by 0 days.

(21) Appl. No.: 14/977,066

(22) Filed: Dec. 21, 2015

(65) Prior Publication Data

US 2016/0209186 A1 Jul. 21, 2016

Related U.S. Application Data

(63) Continuation-in-part of application No. 14/599,217, filed on Jan. 16, 2015, now Pat. No. 9,217,626.

(51) Int. Cl.

| | |
|---|---|
| ***F42B 7/02*** | (2006.01) |
| ***F42B 5/02*** | (2006.01) |
| ***F42B 5/32*** | (2006.01) |
| ***F42B 8/02*** | (2006.01) |
| ***F41A 19/15*** | (2006.01) |
| ***F41A 19/27*** | (2006.01) |
| ***F42C 19/08*** | (2006.01) |
| ***F41A 19/25*** | (2006.01) |
| ***F41A 19/13*** | (2006.01) |
| ***F41A 33/00*** | (2006.01) |
| *F42B 33/00* | (2006.01) |

(52) U.S. Cl.

CPC ..... *F42B 5/02* (2013.01); *F41A 19/13* (2013.01); *F41A 19/15* (2013.01); *F41A 19/25* (2013.01); *F41A 19/27* (2013.01); *F41A 33/00* (2013.01); *F42B 5/32* (2013.01); *F42B 8/02* (2013.01); *F42C 19/083* (2013.01); *F42B 33/001* (2013.01)

(58) Field of Classification Search

CPC ..... F42B 5/02; F42B 5/32; F42B 8/02; F42B 33/001; F41A 19/15; F41A 19/25; F41A 19/27; F42C 19/083

USPC ..... 102/471

See application file for complete search history.

(56) References Cited

U.S. PATENT DOCUMENTS

| | | | | |
|---|---|---|---|---|
| 2,107,034 A * | 2/1938 | Guthrie | ..... | F42B 8/10 102/446 |
| 3,127,836 A | 4/1964 | Silva | | |
| 3,293,979 A | 12/1966 | Woodring | | |
| 3,429,262 A | 2/1969 | Kincheloe | | |

(Continued)

FOREIGN PATENT DOCUMENTS

| | | |
|---|---|---|
| DE | 1933285 | 1/1971 |
| WO | WO-01/81854 A1 | 11/2001 |

OTHER PUBLICATIONS

VarmintHunters.com, "Thompson Center Encore—Centerfire to Rimfire?", posts range from Jun. 20, 2009-Jul. 28, 2015.*

(Continued)

*Primary Examiner* — Samir Abdosh

(74) *Attorney, Agent, or Firm* — Marshall, Gerstein & Borun LLP

(57) ABSTRACT

A non-centerfire mechanical firing device designed to operate with a non-centerfire cartridge, wherein a conventional centerfire or rimfire cartridge is not able to be fired from the non-centerfire firing device.

16 Claims, 14 Drawing Sheets

(56) References Cited

U.S. PATENT DOCUMENTS

| | | | | | |
|---|---|---|---|---|---|
| 3,858,342 | A | * | 1/1975 | Langsford | F41A 21/12 42/16 |
| 3,997,995 | A | * | 12/1976 | Hicks | F42B 8/10 102/446 |
| 4,430,940 | A | * | 2/1984 | Jermunson | F42B 8/10 102/446 |
| 4,702,170 | A | | 10/1987 | Trudeau | |
| 5,000,094 | A | | 3/1991 | Sullivan | |
| 5,363,769 | A | | 11/1994 | Bellak et al. | |
| 6,061,944 | A | | 5/2000 | Schroeder | |
| 8,220,393 | B2 | | 7/2012 | Schluckebier et al. | |
| 8,985,004 | B2 | | 3/2015 | DeJong | |
| 2003/0145754 | A1 | | 8/2003 | Saxby | |
| 2004/0112243 | A1 | | 6/2004 | Amick | |
| 2005/0034558 | A1 | | 2/2005 | Amick | |
| 2010/0101444 | A1 | | 4/2010 | Schluckebier et al. | |
| 2012/0132099 | A1 | | 5/2012 | Busky et al. | |

OTHER PUBLICATIONS

TheFiringLine.com, "Converting centerfire to rimfire", posts range from Apr. 22, 2015-Apr. 26, 2015.*

Screenshot of the video uploaded to Youtube.com by user "SafeArmsReview" on Aug. 8, 2009, "CMMG 22LR Conversion Bolt Range Review—shoot 22LR out of your AR-15 quick & easy"; https://www.youtube.com/watch?v=iE51JWSumYA.*

Communication—Partial Search Report, dated Jun. 10, 2016, European Application No. 16151664.6 (6 pages).

Non-Final Office Action in U.S. Appl. No. 14/599,217, dated Apr. 16, 2015.

Communication pursuant to Rule 62 EPC dated Oct. 24, 2016 by the European Patent Office for European Application No. 16151664.6 (13 pages).

* cited by examiner

LESS-LETHAL MUNITION AND MECHANICAL FIRING DEVICE

RELATED APPLICATIONS

This patent application is related to, and claims the filing benefit of U.S. patent application Ser. No. 14/599,217, filed Jan. 16, 2015; the contents of which are incorporated herein.

TECHNICAL FIELD

The invention relates generally to the field of munitions, and more specifically to a less-lethal cartridge and mechanical firing device.

BACKGROUND

Conventional munitions for small arms, i.e., revolvers, pistols, rifles; and light weapons, i.e., hand-held grenade launchers, recoilless rifles; typically utilize a cartridge with a rimfire or centerfire primer. When the hammer or firing pin of the mechanical firing device, for example, a firearm, impacts the priming or primer compound, the primer compound explodes to ignite the propellant charge within the cartridge and the projectile is expelled from the cartridge casing.

Generally speaking, a conventional firearm may be used with lethal or less-lethal cartridges. Munitions are available in different calibers, gauges, and loads for a variety of purposes. Military, police, and security forces typically employ lethal and less-lethal cartridges for self-defense, refugee control, crowd control, riot control, and prisoner control. Lethal cartridges are intended to cause grave bodily injury and even death to a living target. Less-lethal cartridges are intended to be less likely to significantly wound or kill a living target and although a severe casualty or death may result whenever lethal or less-lethal force is applied, a less-lethal cartridge is intended to minimize that risk.

A conventional firearm with a less-lethal cartridge may be referred to as a non-lethal weapon, less-lethal weapon, a less-than-lethal weapon, a non-deadly weapon, a compliance weapon, riot gun, less-lethal launcher, or a pain-inducing weapon. Much of the construction of the customary less-lethal cartridge, such as the size of the cartridge and the use of a centerfire primer, is essentially identical to the conventional lethal cartridge except that the less-lethal cartridge includes less powder charge, and/or the projectile of the less-lethal cartridge is made of a low-density material, such as rubber. Because the less-lethal and lethal cartridges are similarly constructed, both types of cartridges are compatible with a conventional firearm. While this interchangeability is at times beneficial, it also poses a danger to a user who unknowingly loads a lethal cartridge into the conventional firearm for response to a less-lethal situation. In addition, if law enforcement personnel were to lose possession or control of the conventional firearm being used with less-lethal ammunition as a less-lethal weapon in a less-lethal situation, the conventional firearm may readily be used by an unwanted user with lethal cartridges as a lethal weapon. A need therefore exists for a less-lethal cartridge and a compatible less-lethal firearm, wherein conventional lethal cartridges are not able to be readily used with the less-lethal firearm.

SUMMARY

The present invention is directed to less-lethal ammunition and use of a compatible less-lethal mechanical firing device, wherein a conventional lethal cartridge is not able to be fired from the less-lethal firing device. More particularly, the present invention includes a non-centerfire firearm specifically designed to operate with a non-centerfire less-lethal cartridge, wherein a conventional cartridge is not able to be fired from the non-centerfire firearm. Consequently, the non-centerfire firearm is able to fire a less-lethal non-centerfire cartridge, but is not able to fire a conventional lethal cartridge having a rimfire or centerfire primer.

In accordance with one example embodiment, the present invention described herein is directed to a cartridge for cooperative operation with a non-centerfire firing device having an offset firing pin assembly. The cartridge includes a cylindrical casing including a case head proximate a first end, a hull proximate a second end, and an interior disposed within the casing between the first end and the second end. A non-centerfire propellant assembly includes a non-centerfire primer assembly operatively positioned near a propellant charge. A recess is defined within the case head and includes an opening centrally located proximate the first end of the case head for receiving the non-centerfire primer assembly. The non-centerfire primer assembly is located within the opening and includes an annulus incendiary portion coaxially aligned with the casing. The annulus incendiary portion surrounds an inert portion centrally located within the first end of the case head, wherein the annulus incendiary portion includes a primer compound and the inert portion is absent the primer compound. A projectile is affixed to and/or within the hull proximate the second end of the casing, wherein the propellant charge is capable of being ignited when the cartridge is loaded within the non-centerfire firearm and the annulus incendiary portion of the non-centerfire primer assembly is struck by the offset firing pin assembly.

In accordance with another example embodiment, the present invention includes an offset firing pin assembly for facilitating use of a non-centerfire cartridge including a non-centerfire propellant assembly with a firing device having a centerfire or rimfire trigger assembly. The offset firing pin assembly includes an offset retainer including a first end and a second end. An opening extends through the offset retainer to the first and second ends, and a firing pin is disposed within the opening and capable of extending beyond the first and second ends of the offset retainer, wherein in response to the firing pin receiving an impact force by the trigger assembly, the firing pin is configured to transfer the received force to impact the non-centerfire propellant assembly of the non-centerfire cartridge when loaded in battery position of the firing device and in response to actuation of the trigger assembly.

In accordance with another example embodiment, the present invention includes a method of manufacturing a less-lethal non-centerfire cartridge for use with a mechanical firing device including a non-centerfire firing system. The method includes providing a cartridge including a casing and a case head, adapting a non-centerfire propellant assembly to the case head, and disposing a projectile within the casing.

In accordance with another example embodiment, the present invention includes a method for configuring a centerfire firing device to a non-centerfire device for firing a non-centerfire cartridge. The centerfire firing device includes a trigger assembly and a centerfire firing pin assembly for striking a centerfire cartridge, wherein the method includes removing the centerfire firing pin assembly from the centerfire firing device, and installing an offset firing pin assembly into the centerfire firing device.

BRIEF DESCRIPTION OF THE DRAWINGS

The figures described below depict various aspects of the devices, systems, and methods disclosed herein. It should be understood that each figure depicts an embodiment of a particular aspect of the disclosed system and methods, and that each of the figures is intended to accord with a possible embodiment thereof. Further, wherever possible, the following description refers to the reference numerals included in the following figures, in which features depicted in multiple figures are designated with consistent reference numerals.

DETAILED DESCRIPTION

Figure 1:
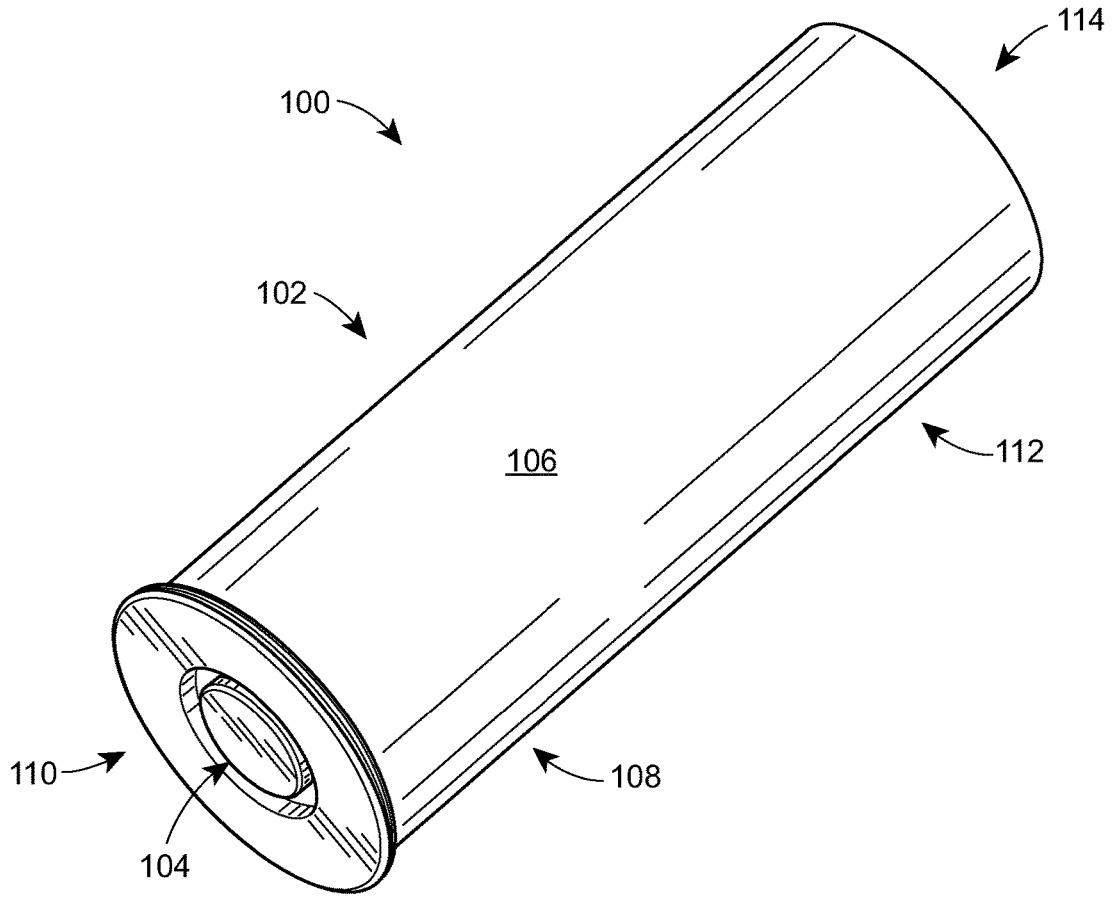
FIG. 1 is a perspective view of one embodiment of a non-centerfire cartridge of the present invention as described herein.

FIG. 1 is a perspective view of one embodiment of the present invention directed to non-centerfire ammunition 100. The ammunition includes a cartridge 102 having a non-centerfire propellant assembly 104 and a cylindrically-shaped casing 106 retaining a projectile (not shown) thereto and/or therein. The casing 106 includes a case head 108 proximate a first end 110 of the cartridge 100 and the casing 106, and a hull 112 or hull body proximate a second end 114 of the cartridge 100 and the casing 106. The case head 108 and hull 112 of the casing 106 may be constructed of a unitary piece of material, for example, aluminum, that has been machined, formed, stamped, and/or drawn to form the casing 106. The casing 106, case head 108, and/or hull 112 may also be formed or generated using a 3D printer. Alternatively, the case head 108 and hull 112 may be contiguous pieces of similar or different material and integrated to each other. For example, the case head 108 may be a metal or metal alloy and the hull 112 may be plastic, paper, polymer, and the like, and vice-versa.

Figure 2:
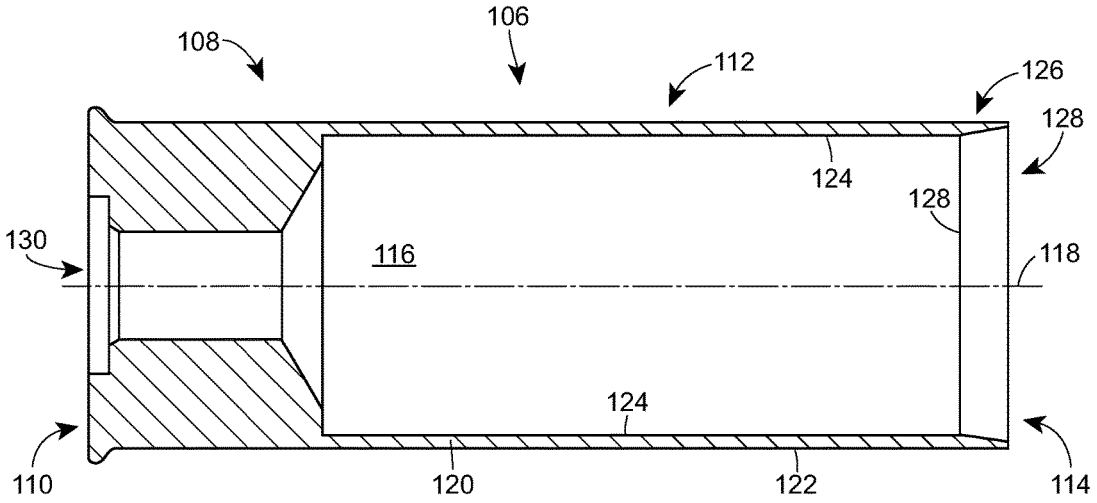
FIG. 2 is a cross-section view of the casing of the non-centerfire cartridge shown in FIG. 1.

FIG. 2 is a cross-sectional illustration of one embodiment of the casing 106 shown in FIG. 1. The casing 106 encompasses an interior 116 and includes a longitudinal axis 118 extending through the first 110 and second 114 ends of the casing 106. The first 110 and second 114 ends of the casing 106 lie within respective planes that are substantially perpendicular to the longitudinal axis 118 of the casing 106. In general, the hull 112 of the casing 106 includes a circumference or wall 120 having an exterior surface 122 and an interior surface 124. The thickness of the casing 106, for example, near the wall 120 of the hull 112, is substantially equal to the distance between the interior 124 and exterior 122 surfaces of the casing 106. In other words, the thickness of the wall 120 is substantially equal to an outer diameter of a portion of the casing 106 minus an interior diameter of the corresponding portion of the casing 106. The thickness of the wall 120 may taper 126 near the second 114 end of the casing 106 to facilitate crimping or deforming the casing 106 proximate the second end 114 of the casing 106 to fully or partially enclose the interior 116 of the hull 112. Portions of the hull 112 proximate the second end 114 of the casing 106 may also include means for affixing 128 the projectile (not shown) to and/or within the hull 112 proximate the second end 114 of the casing 106. Examples of the means for affixing 128 the projectile to and/or within the hull 112 include, and are not limited to, seams, creases, tapering, and a like within the wall 120 of the casing 106 to facilitate manipulating, folding, or bending, the wall 120, as well as a plug, disc, and/or rolled edge to retain the projectile to and/or within the hull 112.

At least a portion of the case head 108 includes an opening 130 centrally located within the case head 108 proximate the first end 110 of the casing 106. The opening 130 is shown as circular and coaxially aligned with the longitudinal axis 118 of the casing 106. At least a portion of the non-centerfire propellant assembly (not shown) is disposed within the opening 130 and retained therein.

Figure 3:
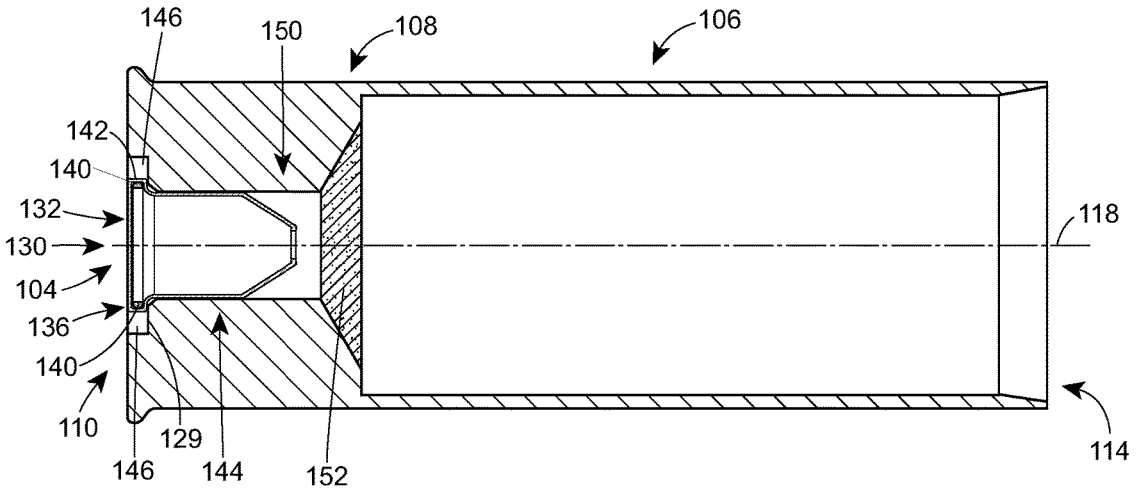
FIG. 3 is a cross-section view illustrating one embodiment of a non-centerfire propellant assembly implemented within the casing shown in FIG. 2.

FIG. 3 is a cross-section illustration of the casing shown in FIG. 2 with one embodiment of the non-centerfire propellant assembly 104 disposed therein. The non-centerfire propellant assembly 104 includes a non-centerfire primer assembly 150 disposed within the opening 130 and proximate a propellant charge 152 or powder charge. The non-centerfire primer assembly 150 and the propellant charge 152 of the non-centerfire propellant assembly 104 are combined or located sufficiently near each other so that ignition of the non-centerfire primer assembly 150 will ignite the propellant charge 152.

Figure 4:
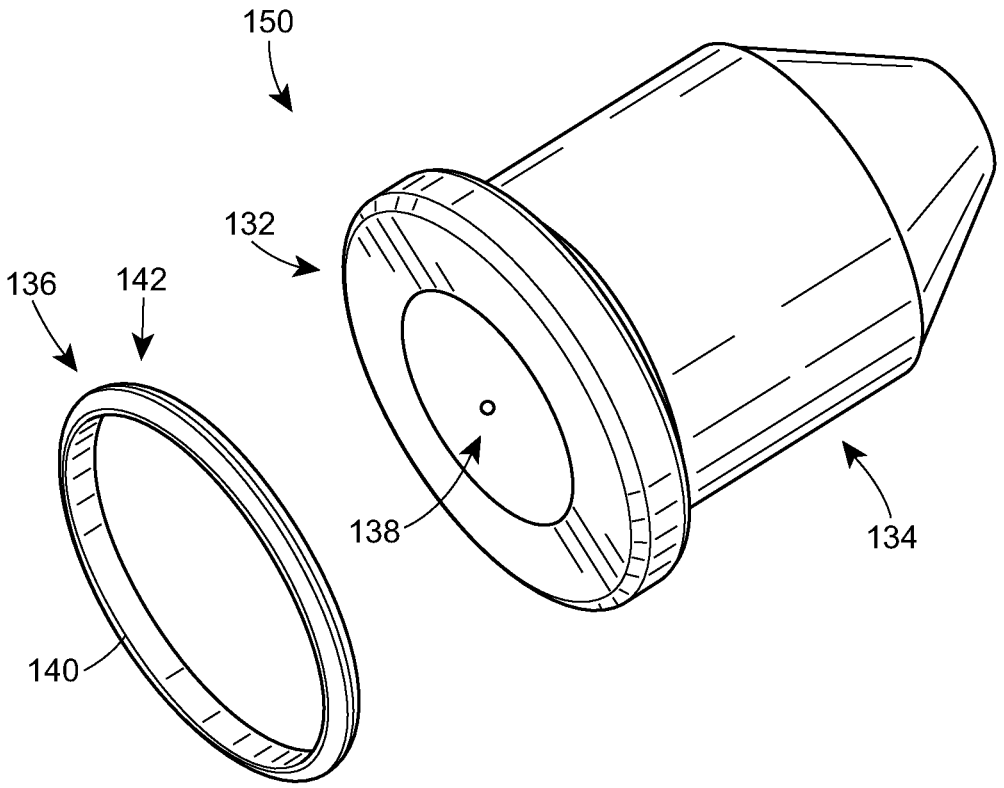
FIG. 4 is an exploded view of one embodiment of a non-centerfire primer assembly described herein.

FIG. 4 illustrates one embodiment of the non-centerfire primer assembly 150 positioned within the opening 130 shown in FIG. 3. The non-centerfire primer assembly 150, which may at times be referred to as a power cartridge, includes a base 132 and a cap 134. The power cartridge is illustrated as a one piece, drawn steel case. The base 132 of the non-centerfire primer assembly 150 includes an annulus incendiary portion 136 surrounding an inert portion 138. The annulus incendiary portion 136 includes a priming or primer compound 140 disposed about a perimeter or rim 142 of the base 132.

Figure 5:
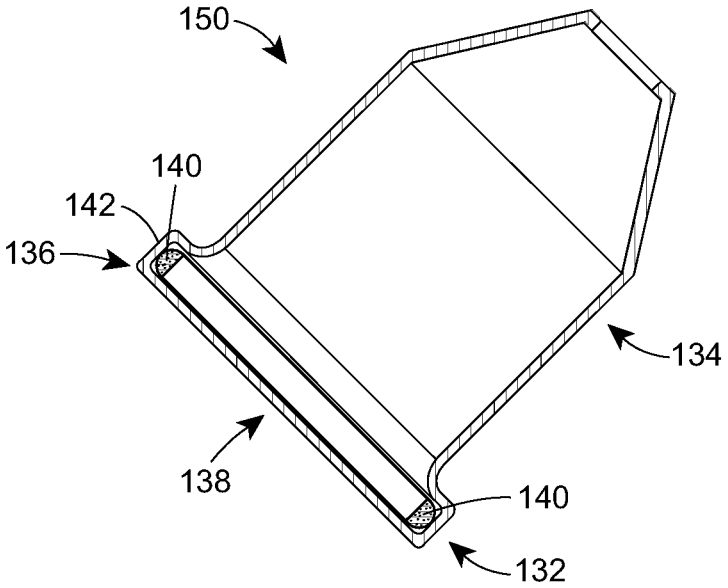
FIG. 5 is a cross-section view of the non-centerfire primer assembly shown in FIG. 4

FIG. 5 is a cross-section illustration of the non-centerfire primer assembly 150 shown in FIG. 4. The rim 142 of the non-centerfire primer assembly 150 may include a fold, channel, or groove, wherein the primer compound 140 is encapsulated and substantially confined within the rim 142 of the base 132. The inert portion 138, which is centrally located within the base 132, is absent the primer compound.

Referring again to FIG. 3, when the non-centerfire primer assembly 150 is integrated within the opening 130 of the case head 108, the annulus incendiary portion 136 including the primer compound 140 and the rim 142 of the non-centerfire primer assembly 150 are coaxially aligned with the casing 106 along the longitudinal axis 118 of the casing 106. To facilitate operative placement and retention of the non-centerfire primer assembly 150 within the case head 108 of the casing 106, a means for coupling 144 the non-centerfire primer assembly 150 may include a recess 129 within the case head 108 and surrounding the opening 130. The rim 142 of the base 132 of the non-centerfire primer assembly 150 may include a footing or shoulder that abuts the recess 129 to align the base 132 of the non-centerfire primer assembly 150 within substantially the same plane as the first end 110 of the casing 106. That is, the base 132 of the non-centerfire primer assembly 150 and the first end 110 of the casing 106 are substantially coplanar.

Figure 6:
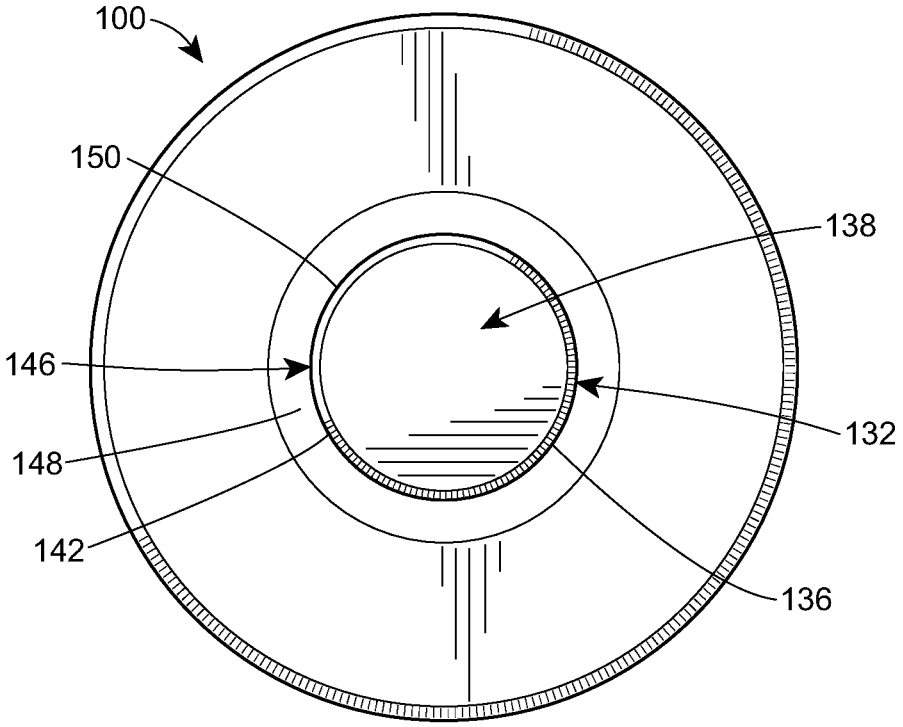
FIG. 6 is a view of one embodiment of the case head of the casing along the longitudinal axis of the cartridge shown in FIG. 1

FIG. 6 is an illustration of the first end 110 of the cartridge 100 as viewed along the longitudinal axis 118 of the casing 106 and illustrates the non-centerfire primer assembly 150 positioned within the opening 130 of the case head 108. The first end 110 of the casing 106 may include a means for facilitating ignition 146 of the primer compound 140 within the rim 142 of the base 132 of the non-centerfire primer assembly 150. The means for facilitating ignition 146 may include a space 148 for the annulus incendiary portion 136 of the base 132 to deform in response to the firing pin or hammer of the firing device striking or impacting the rim 142 of the base 132. As shown in FIG. 6, the space 148 provides an area into which the fold, channel, or groove of the rim 142 may deform. For example, in response to being struck by the firing pin of the firearm, the rim 142 may be pinched or squeezed and collapse upon the incendiary portion 136 and ignite the primer compound 140. In contrast, the inert region 138 of the base 132 is centrally located within the case head 108 and proximate the longitudinal axis 118 of the casing 106 is absent the primer compound. As such, the striking of the firing pin to this inert region 138 of the base 132 will not ignite the primer compound 140 of the non-centerfire primer assembly 150, and thus the powder compound 152 will not be ignited.

Figure 7:
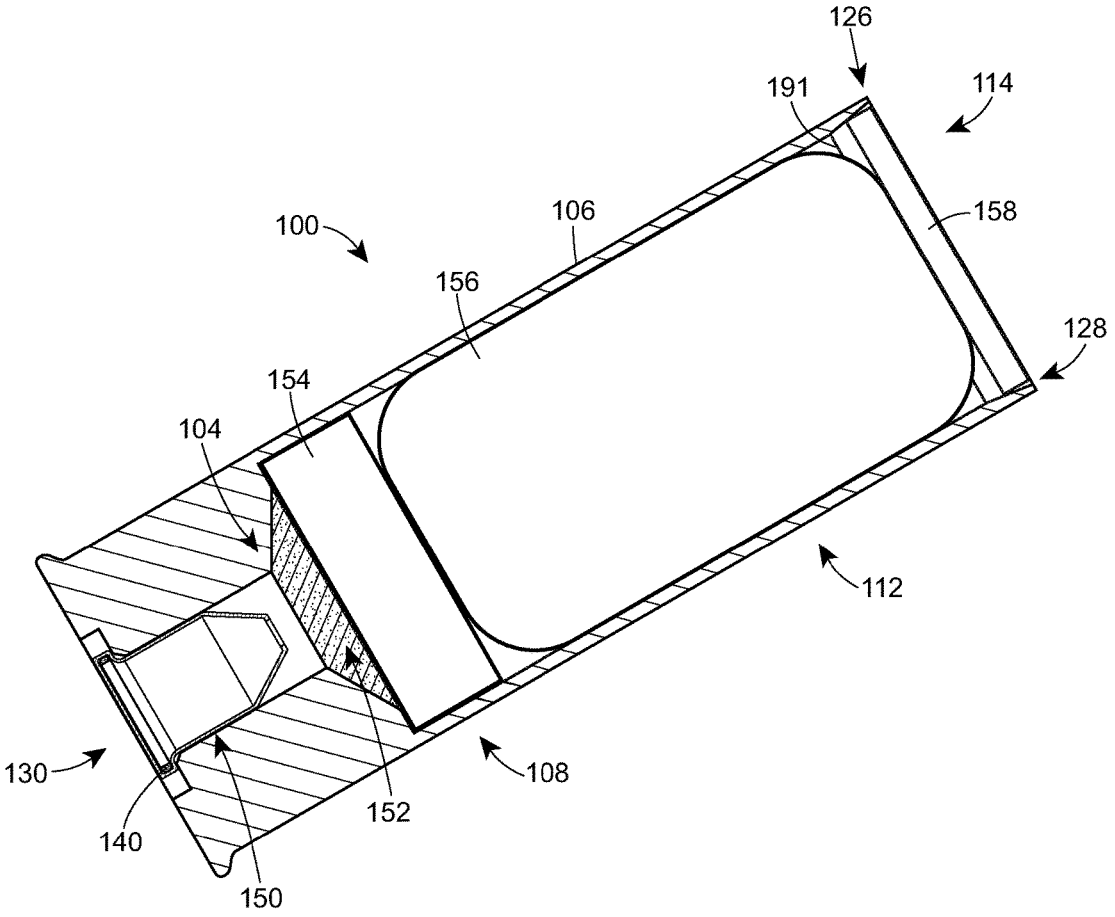
FIG. 7 is a cross-section view of the non-centerfire cartridge shown in FIG. 1.

FIG. 7 is a cross-sectional illustration of the cartridge 100 illustrated in FIG. 1. The cartridge 100 incorporates the non-centerfire propellant assembly 104, which includes the non-centerfire primer assembly 150 disposed within the opening 130 of the case head 108 and proximate the propellant or powder charge 152 within the casing 106. Retention of the non-centerfire primer assembly 150 within the opening 130 of the case head 108 may be by friction fit or any other known method relating to retaining a primer within a cartridge. The propellant or powder charge 152 is located within or sufficiently near the non-centerfire primer assembly 150 such that ignition of the primer compound 140 will then ignite the propellant charge 152. The propellant charge includes another explosive material that will ignite in response to the ignition of the primer compound of the annulus incendiary portion of the non-centerfire primer assembly being struck by the firing pin and alike of the firing device. Ignition of the propellant charge creates gases that increase in pressure and the projectile 156 will eventually be dislodged from the casing and expelled from the firing device. A seal 154 is proximate the propellant charge 152 and provides a gas seal to prevent the propellant charge 152 from mixing with the projectile 156 and blowing through the projectile 156 rather than propelling the projectile 156 from the casing 106 after the cartridge 100 has been fired. The seal 154 may include a wad or protective cup for containing the projectile 156 until the projectile 156 exits the firing device.

The second end 114 of the casing 106 includes a means for affixing 128 the projectile 156 to and/or within the casing 106. The means for affixing 128 may include structural features of the casing 106 near the hull 112 such as the tapered wall 126 or a preformed crease 191 proximate the second end 114 of the casing 106, and/or an inherit pliability associated with the malleableness of the material composition of the casing 106 to facilitate shaping the casing 106 about its second end 114. When shaped, the folded, rolled, or crimped portion of the hull 112 may extend toward the longitudinal axis 118 of the casing 106 to retain the projectile 156 within the hull 112 and/or affix the projectile 156 to the casing 106 until the cartridge 100 is fired. In addition to or in place of the tapered wall 126 and/or formability characteristics of the hull 112, the means for affixing 128 the projectile to and/or within the casing 106 may include a stop such as a disc or plate 158 inserted or attached proximate the second end 114 of the casing 106.

Figure 8:
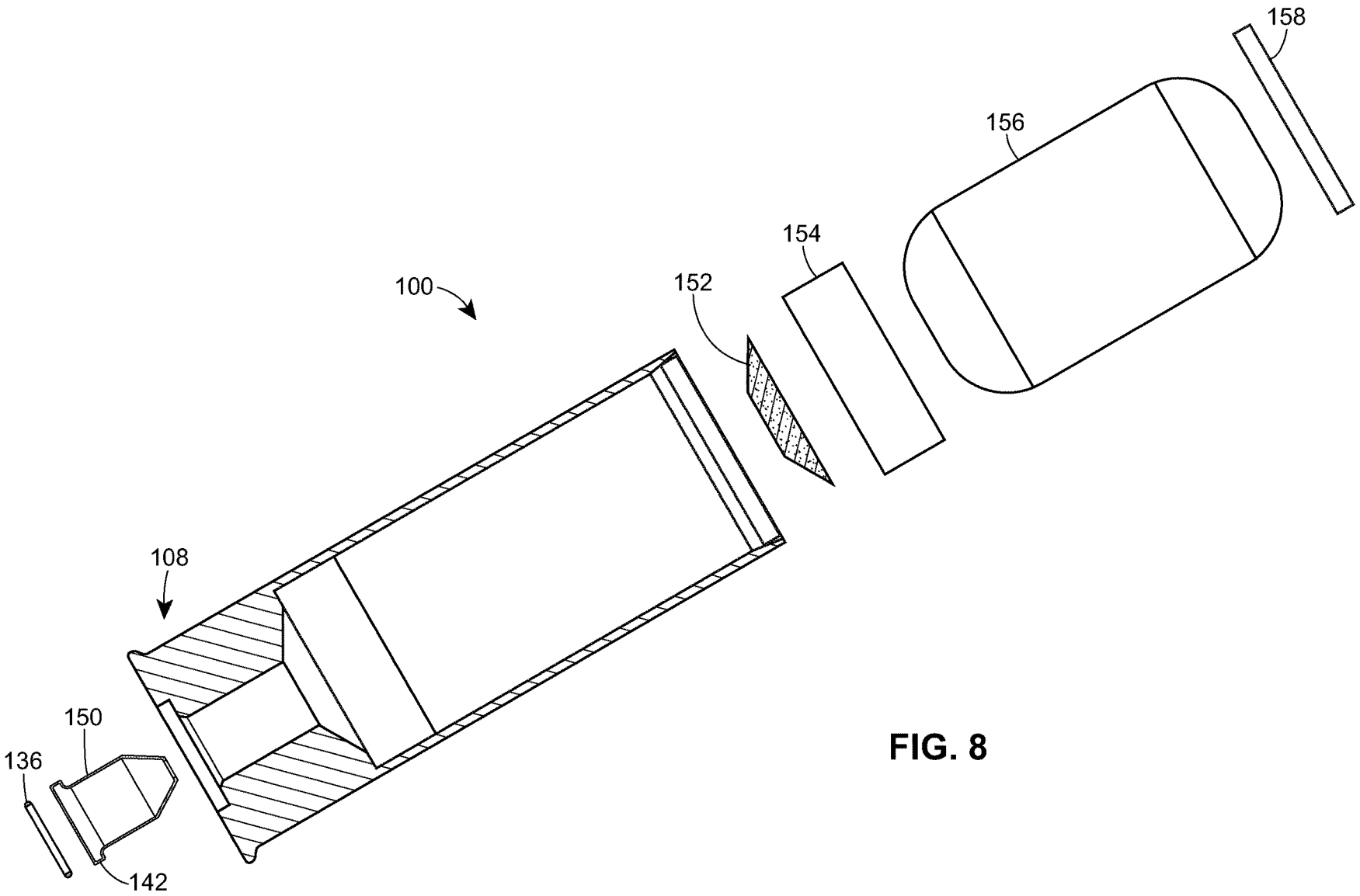
FIG. 8 is an exploded view the non-centerfire cartridge shown in FIG. 1.

FIG. 8 is an exploded view of the cartridge 100 shown in FIG. 7. The cartridge 100 includes the annulus incendiary portion 136 positioned about the rim 142 of the non-centerfire primer assembly 150. The non-centerfire primer assembly 150 resides within the case head 108 and is positioned near the propellant charge 152. The seal 154 resides between the propellant charge 152 and the projectile 156. The second end 114 of the casing 106 includes the disc 158 as part of the means for affixing 128 the projectile within and/or to the casing 106.

Figure 9:
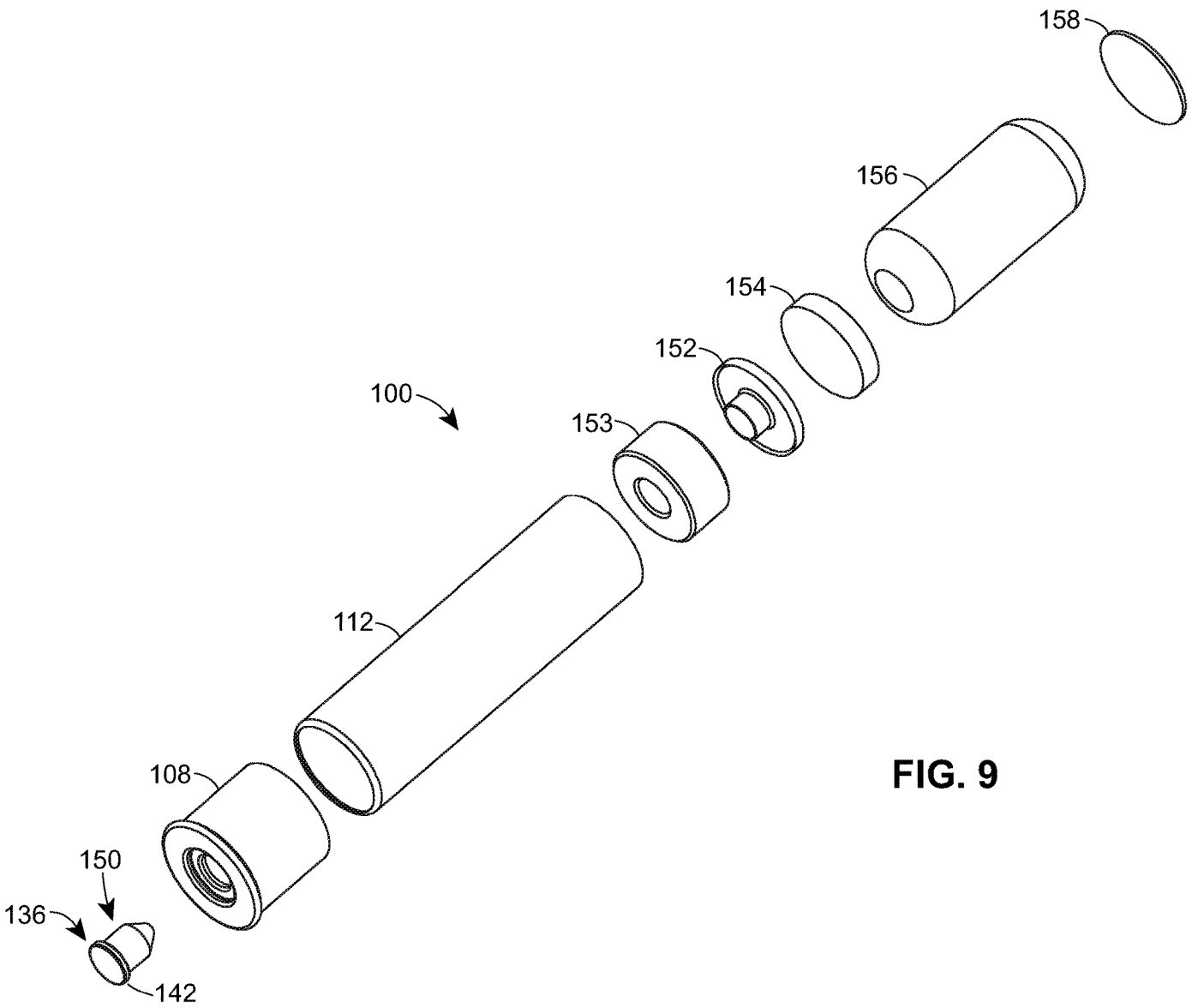
FIG. 9 is an exploded view of an alternate embodiment of the non-centerfire cartridge of the present invention described herein.

FIG. 9 is an exploded view of an alternate embodiment of the cartridge 100 described herein. The non-centerfire primer assembly 150, which includes the annulus incendiary portion 136 positioned about the rim 142, resides within the case head 108 near the propellant charge 152. A base wad 153 resides with the hull body 112 between the non-centerfire primer assembly 150 and the propellant charge 152. The seal 154 or fiber disc is positioned between the propellant charge 152 and the projectile 156. A paper disc 158 may be included within the means for retaining the projectile within the hull 112 of the casing 106 until the cartridge 100 is fired by the firing device.

Depending on the intended use of the cartridge 100, the explosive components of the non-centerfire propellant assembly 104, for example, the non-centerfire primer assembly 150 and the propellant charge 152 may be of a type and amount appropriate for a lethal or a non-lethal purpose. In addition, the design and material composition of the projectile 156 may be based on its intended use. For lethal applications, the projectile 156 may be comprised primarily of metal. For less-lethal applications, the projectile 156 may include a non-metal material, for example, polymer, rubber; of varying shapes and sizes, for example, spheres, bean bag. The casing 106 may include an indicator such as a shape or description denoting the intended application for the cartridge 100. For example, lethal or less-lethal applications for the cartridge 100 may be distinguished by the exterior surface of the casing 106, which may include a visible and/or tangible identifier such as a color, symbol, and/or a textured pattern, for example, a multi-sided geometric shape such as an octagonal-shaped circumference, stripes, and/or tactile cross-hatching.

Figure 10:
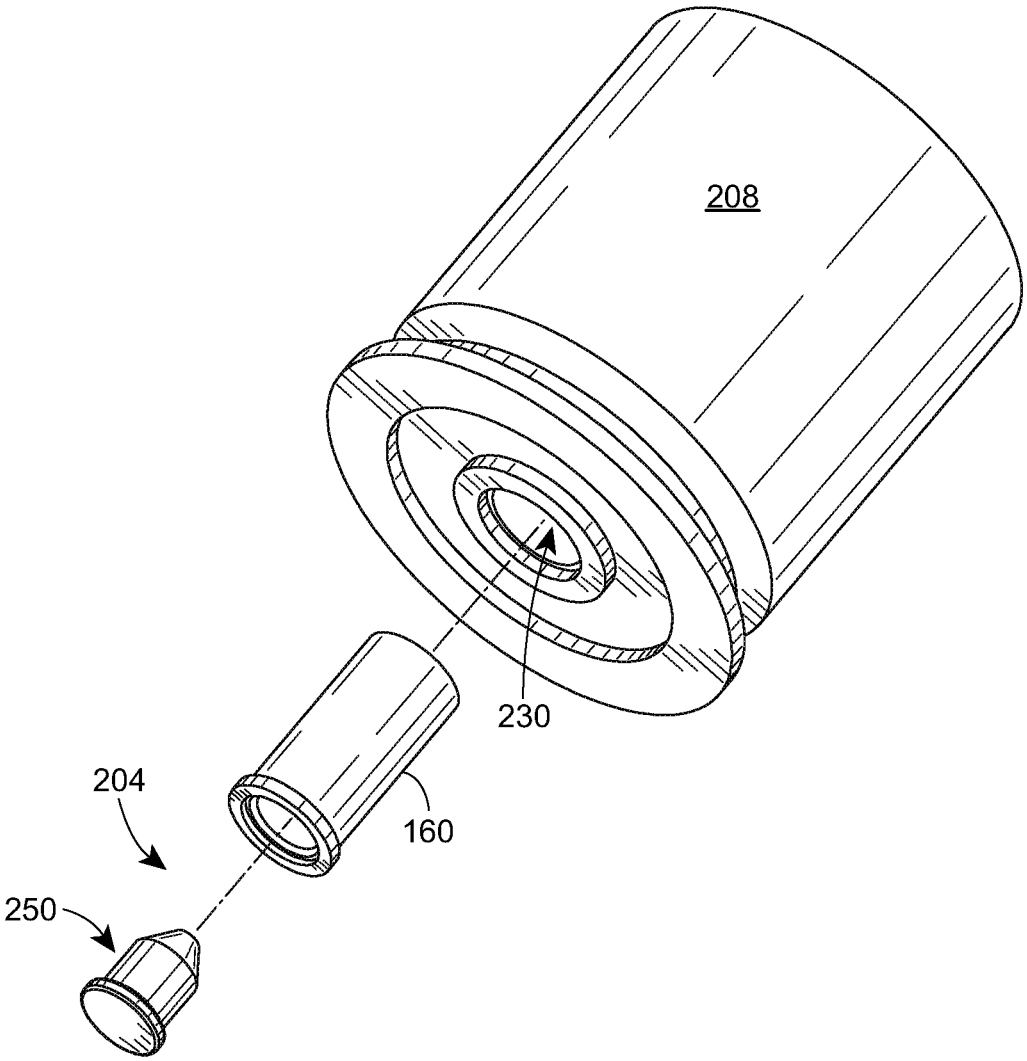
FIG. 10 is an exploded view of an embodiment of the non-centerfire propellant assembly of the present invention as described herein.

Referring now to FIG. 10, an exploded view of an alternate embodiment of the non-centerfire propellant assembly 204 is illustrated. The non-centerfire propellant assembly 204 includes the non-centerfire primer assembly 250 that is similar and/or identical to the non-centerfire primer assembly 150 described above in FIGS. 4 and 5. The non-centerfire primer assembly 250 is operatively attached to a propellant charge casing 160 that contains the propellant or powder charge therein. The non-centerfire primer assembly 250 is seated and inserted within an opening 182 in the end of the propellant charge casing 160 to form the non-centerfire propellant assembly 204. The assembly of the non-centerfire primer assembly 250 within the propellant charge casing 160 may be similar to that described in relation to the non-centerfire-primer assembly 150 disposed within the opening 230 of the case head 208 of the casing 106 in FIGS. 3 and 6. That is, the non-centerfire primer assembly 250 may be retained within the powder charge case 160 by an interference fit or any other known manner related to retaining a primer within a casing. Similarly, the non-centerfire propellant assembly 204 may be retained within the opening 230 of the case head 208 in a similar manner.

The opening 182 within the end of the propellant charge case 160 may include a means for facilitating ignition of the primer compound within the rim of the base of the non-centerfire primer assembly 250. The means for facilitating ignition may include a space for the annulus incendiary portion of the base to deform in response to the firing pin or hammer of the firing device striking or impacting the rim of the base. The space provides an area into which the fold, channel, or groove of the rim may deform. For example, in response to being struck by the firing pin of the firearm, the rim may be pinched or squeezed and collapse upon the incendiary portion and ignite the primer compound. In contrast, the inert region of the base is centrally located within the case head and proximate the longitudinal axis of the cartridge casing is absent the primer compound. As such, the striking of the firing pin to the inert region of the base will not ignite the primer compound of the non-centerfire primer assembly 250, and thus the powder compound within the propellant charge case 160 will not be ignited.

The non-centerfire propellant assembly 204 is disposed within the opening 230 of the case head 208 and adjacent an expansion chamber (not shown) within the case head and/or hull body of the cartridge casing. Upon ignition of the powder charge within the powder charge case 160, which occurs in response to ignition of the primer compound igniting as a result of the rim of the non-centerfire primer assembly 250 being struck by the firing pin of the firing device, gas pressure will increase within the powder charge casing 160 and ultimately explode into the expansion chamber (not shown) to dislodge the projectile from the cartridge casing.

Figure 11:
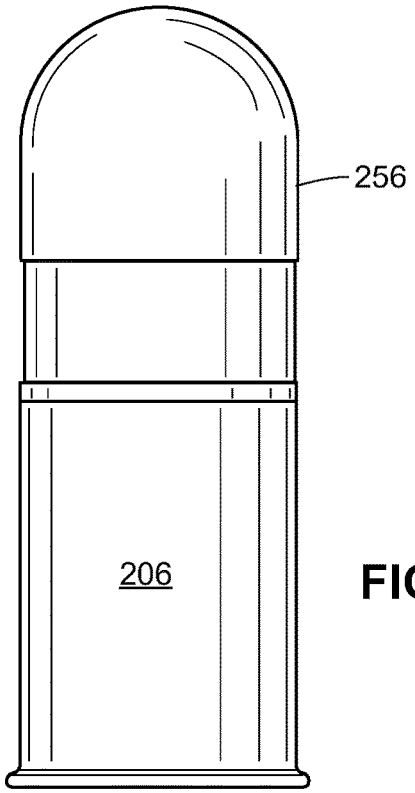
FIG. 11 is an illustration of another alternate embodiment of the non-centerfire cartridge of the present invention as described herein.
Figure 12:
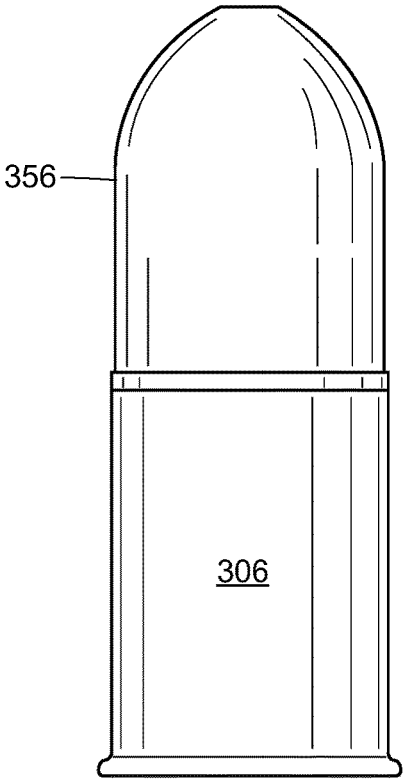
FIG. 12 is an illustration of another alternate embodiment of the non-centerfire cartridge of the present invention as described herein.

The non-centerfire propellant assembly 204 shown in FIG. 10 may be integrated with larger cartridges employing a 37 mm or 40 mm casing. Some examples of the larger cartridges are illustrated in FIGS. 11 and 12. FIG. 11 depicts a 40 mm cartridge with one type of projectile 256 attached to and extending beyond its casing 206 and FIG. 12 depicts a 40 mm cartridge with another type of projectile 356 attached to and extending beyond its casing 306. It is to be understood that although the non-centerfire propellant assembly 204 are implemented with cartridges wherein the projectile 256, 356 extends beyond the casing 206, 306, the non-centerfire propellant assembly 204 is also capable of being implement with a cartridge wherein the projectile is housed entirely or partially within the cartridge casing.

Figure 13:
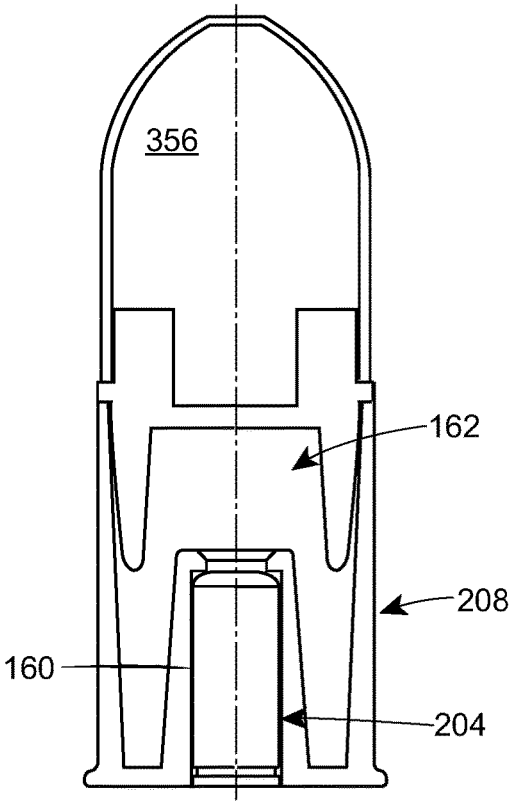
FIG. 13 is an cross-section view of the non-centerfire cartridge shown in FIG. 12.

FIG. 13 is a cross-sectional view of the 40 mm cartridge shown in FIG. 12. The non-centerfire propellant assembly 204 is disposed within the case head 208, wherein the expansion chamber 162 is proximate the propellant charge case 160 of the non-centerfire propellant assembly 204 and the projectile 356. Various interior designs may be incorporated within the case head 208 to receive the non-centerfire propellant assembly 204. Similarly, various designs of the expansion chamber 162 may be defined by the interior of the case head 208, hull, and/or the projectile 356.

Figure 14:
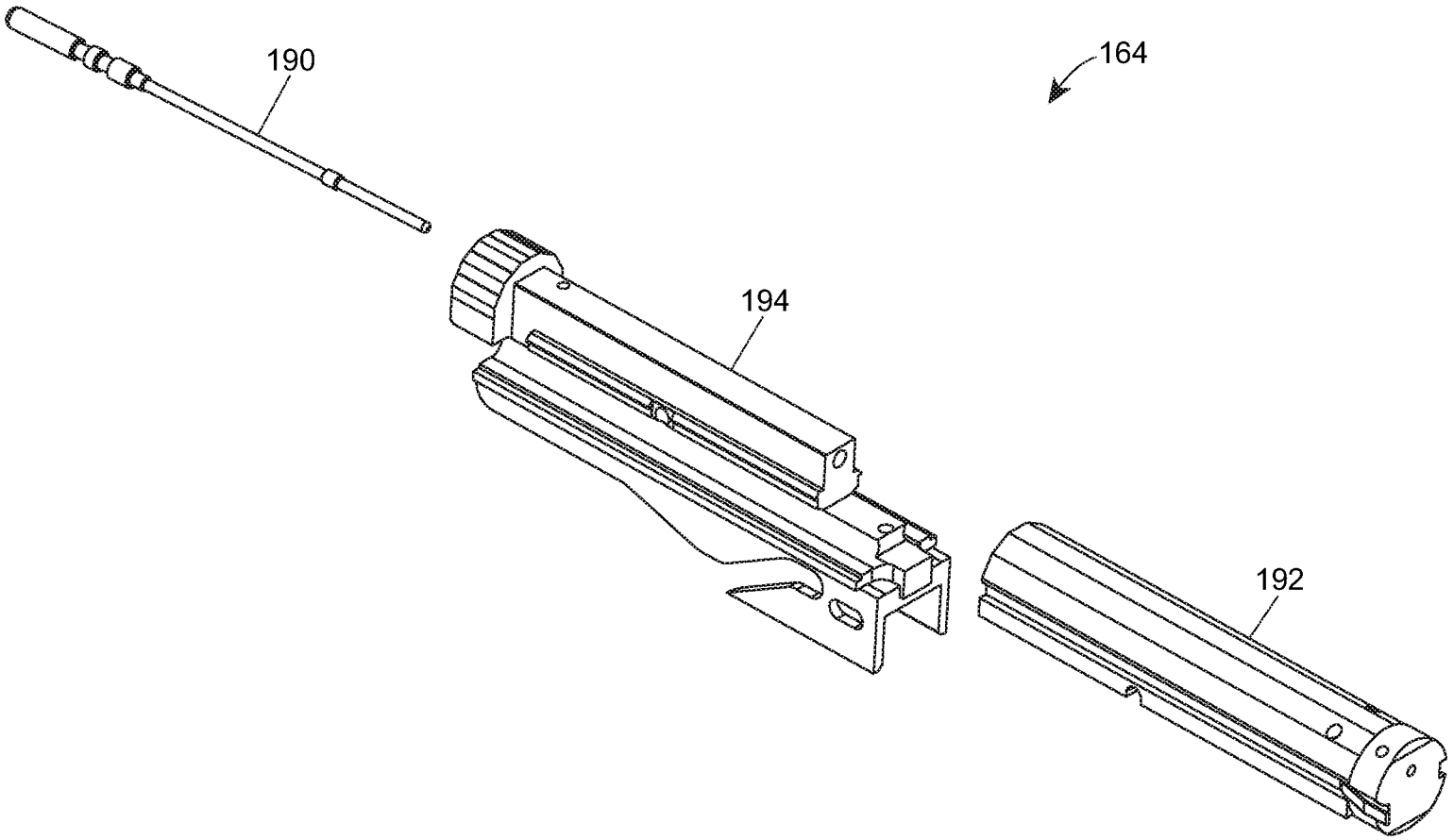
FIG. 14 is an exploded view of an embodiment of an offset firing pin assembly of the present invention as described herein.

FIG. 14 depicts an alternate embodiment of the invention directed to an offset firing pin assembly 164 for a non-centerfire firing device capable of firing larger caliber cartridges and shotshells having the non-centerfire primer assembly described herein; for example, 0.50 caliber, pump action shotgun, semi-automatic shotgun, riot gun (37 mm, 40 mm), less-lethal launcher, paintball gun. The offset firing pin assembly 164 includes a striker 190, for example, firing pin; and a bolt 192, wherein the firing pin 190 is longitudinally positioned through the bolt 192. The firing assembly may also include a bolt carrier 194 capable of being operatively coupled to the bolt 192. The firing assembly 164 is configured to align the firing pin 190 to strike the non-centerfire primer assembly of the non-centerfire cartridge in response to the actuation of a trigger assembly (not shown) operatively coupled to the offset firing pin assembly 164. For example, the offset firing pin assembly 164 may be configured to cooperate with the receiver assembly, trigger assembly, and barrel of the firing device to align the firing pin 190 for contact with the non-centerfire primer assembly of the non-centerfire propellant assembly of the loaded non-centerfire cartridge.

Figure 15:
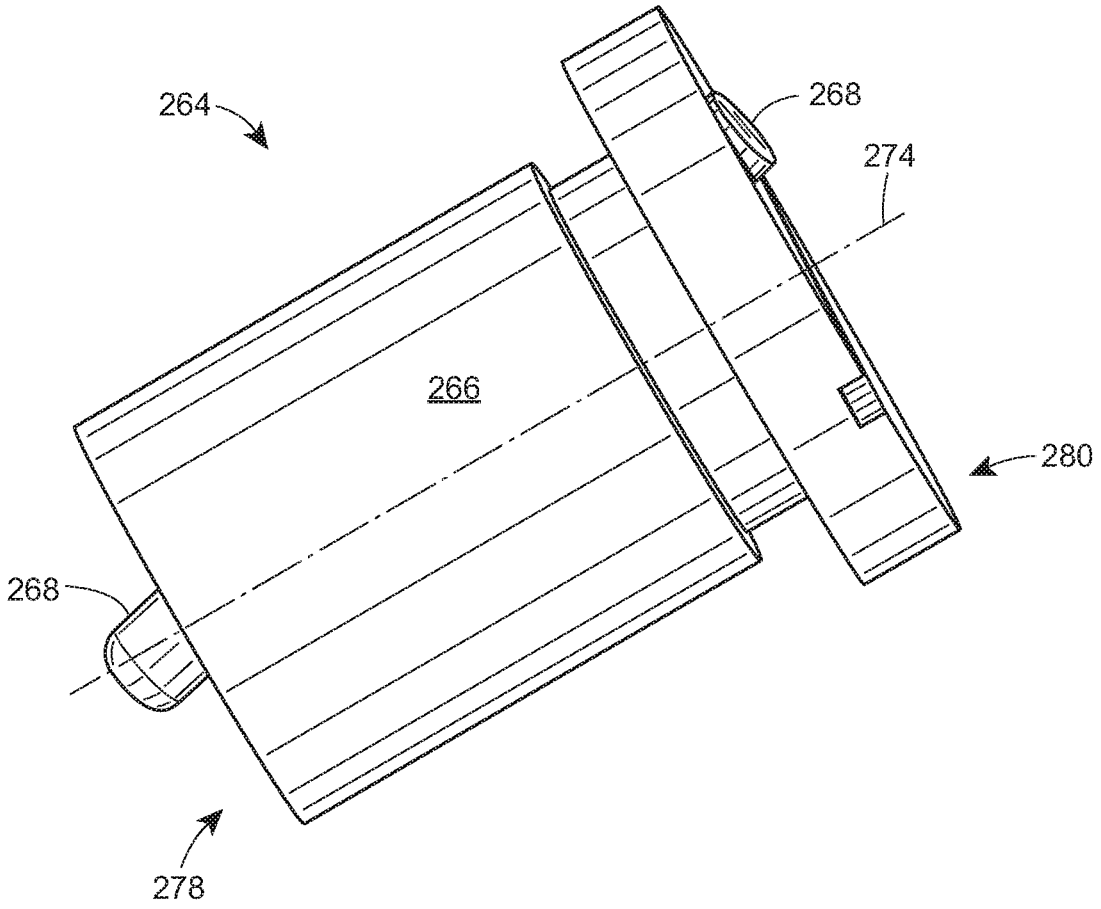
FIG. 15 is an illustration of another embodiment of an offset firing pin assembly of the present invention as described herein.

FIG. 15 is an illustration of an alternate embodiment of the offset firing pin assembly shown in FIG. 14 and designed to transfer the force generated by a trigger assembly of the firing device directed to the center of a cartridge to the incendiary portion of the non-centerfire primer assembly described herein. The offset firing pin assembly 264 includes an offset retainer 266. A firing pin 268, a firing pin spring (not shown), and a firing pin retainer (not shown) are configured with the offset retainer 266 for translating the force exhibited by a striker or hammer of a conventional centerfire firing device to the non-centerfire primer assembly of the non-centerfire cartridge described herein. The offset retainer 266 may be considered a bolt having a generally cylindrical shape and including a longitudinal axis 274 there through. The firing pin 268 is retained within an opening (not shown) that extends between a first end 278 and a second end 280 of the offset retainer 266. When the offset firing pin assembly 266 is implemented within a mechanical firing device, the first end 278 of the offset retainer 266 is proximate the striker or hammer of the firing device for operative cooperation therewith, and the second end 280 of the offset retainer 266 is proximate the non-centerfire cartridge 100 when in battery and ready for firing from the firearm.

Figure 16:
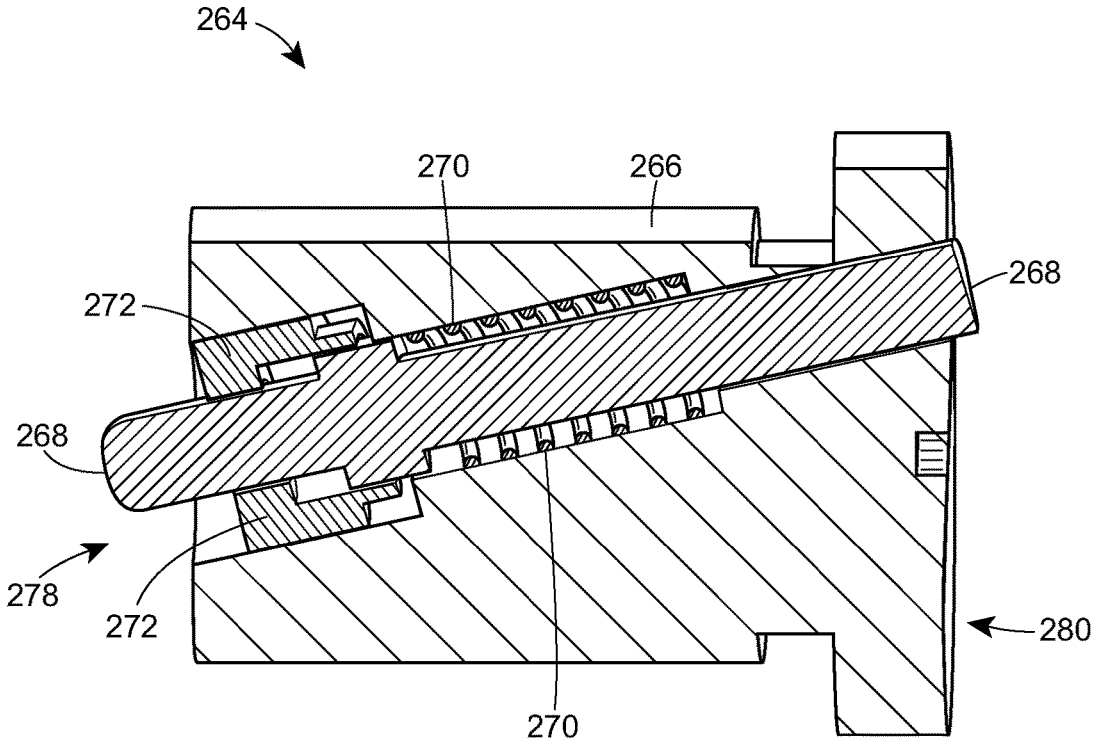
FIG. 16 is a cross-section view of the offset firing pin assembly shown in FIG. 15.

FIG. 16 is cross-sectional view of the offset firing pin assembly shown in FIG. 15. The offset firing pin assembly includes an offset retainer 266 having a longitudinal axis there through (see 274 in FIG. 15). An opening 276 extends through the offset retainer 266 from the first end 278 of the offset retainer 260 to the second end of the offset retainer 266. The firing pin 268, a firing pin spring 270, and a firing pin retainer 272 are operatively configured within the opening 274 of the offset retainer 266 to translate the force received by a striker or hammer of a conventional centerfire firing device at the firing pin 268 at the first end 278 of the offset retainer 266 to the annulus incendiary portion of the non-centerfire primer assembly of the non-centerfire cartridge.

Figure 17:
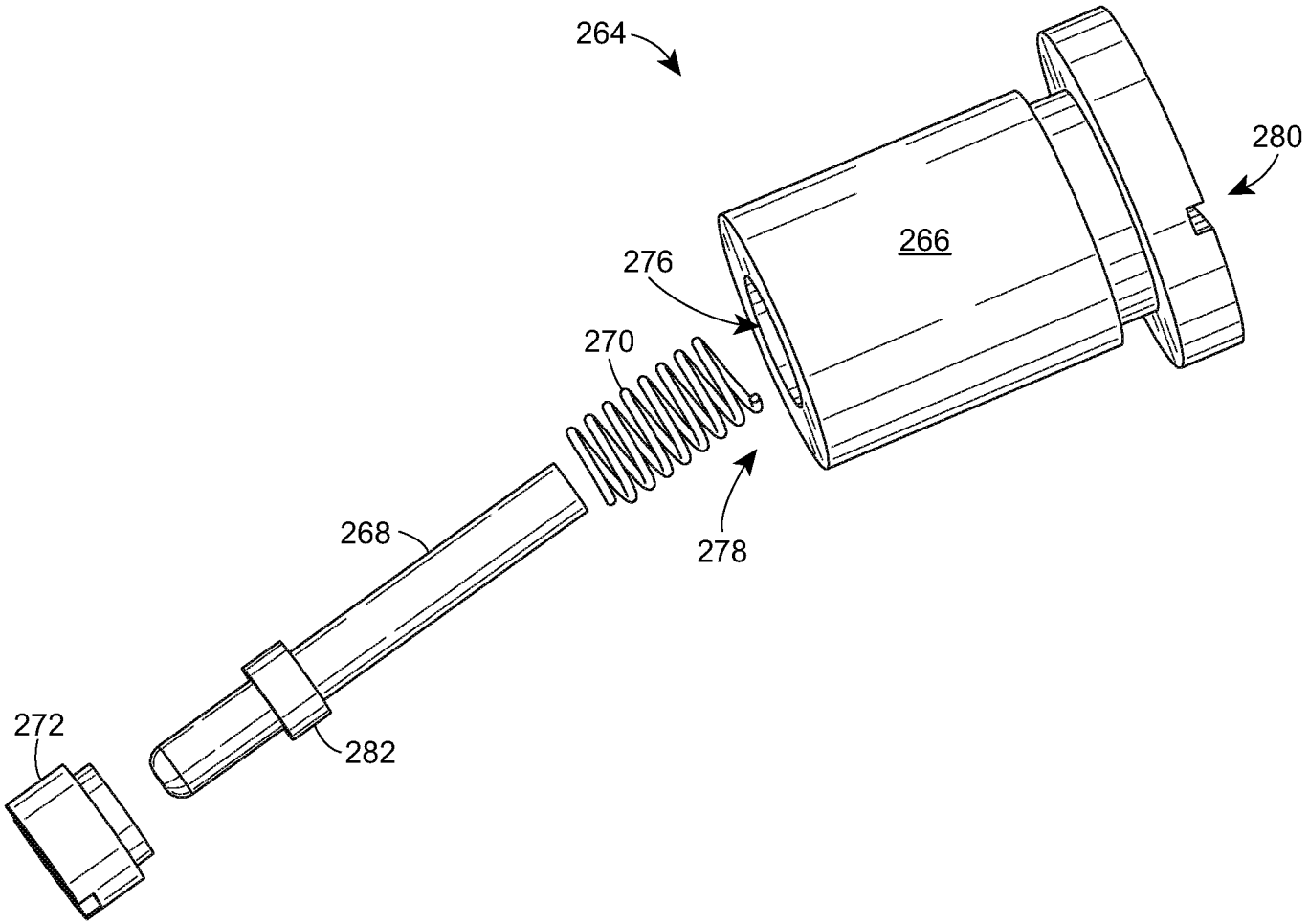
FIG. 17 is an exploded view of the offset firing pin assembly shown in FIG. 15.

FIG. 17 is an exploded view of the offset firing pin assembly 264 shown in FIG. 15 and including the offset retainer 266, the firing pin 268, the firing pin spring 270, and the firing pin retainer 272. The firing pin 268 may include a collar 282 radially extending from the firing pin 268. The collar 282 may be integral to the firing pin 268 or affixed thereto. When the offset firing pin assembly is assembled, the firing pin 268 is positioned within the firing pin spring 270 and within the opening 276 of the offset retainer 266. The firing pin retainer 272 may be ring-shaped and slid onto the firing pin 268. The firing pin retainer 272 cooperates with the interior of the opening 276 of the offset retainer 266 to secure the firing pin 268 within the opening 276. For example, the firing pin retainer 272 may be keyed or threaded to cooperate with the offset retainer 266 and/or the firing pin 268. The firing pin spring 270 cooperates with the opening 276 and the collar 282 to position the firing pin 268 as desired. When the offset firing pin assembly is assembled and at rest, the forces of the firing pin spring 270 pushes the collar 282 of the firing pin 268 toward the first end 278 or striking end of the offset retainer 266. The portion of the firing pin 268 extending from the second side 280 or cartridge side of the offset retainer 266 is positioned so as not to interact with the non-centerfire primer assembly of a cartridge in battery until the firing pin 268 is struck by the trigger assembly of the firing device. That is, when the firing device is activated to fire the cartridge, the striker or hammer of the firing device will contact the centrally locator firing pin 268 at the first end of the offset retainer 266 with sufficient force to compress the firing pin spring 270 via the collar 282 such that the firing pin 268 will move toward the second end 280 of the offset retainer 266 and the cartridge in battery to deform the incendiary portion of the non-centerfire primer assembly.

Figure 18:
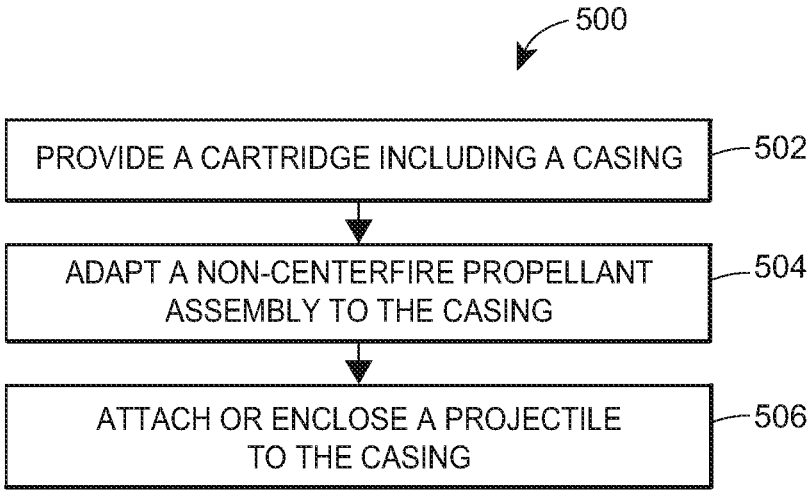
FIG. 18 is an example method for assembling a cartridge with the non-centerfire propellant assembly of the present invention as described herein.

FIG. 18. is a flow diagram of an example method for assembling one embodiment of the non-centerfire cartridge of the present invention. Each component of the non-centerfire cartridge may be manufactured separately by any known means of manufacturing ammunition components and the like and then assembled into the cartridge using any known means of manufacturing ammunition and the like. The method 500 includes providing a cartridge having a casing (block 502). A non-centerfire propellant assembly is adapted to the casing (block 504). The non-centerfire propellant assembly may be partially and/or fully constructed before, during, or after being affixed to the casing. For example, the non-centerfire primer assembly and propellant charge may be separately inserted into the casing and positioned near each other. Alternatively, the non-centerfire primer assembly may be inserted into the casing powder charge to form the non-centerfire propellant assembly, which may then be inserted into the case head. Further, the powder charge case may first be inserted into the case head and then the non-centerfire primer assembly can be inserted within the powder charge case. Similarly, the case head and hull body of the cartridge may be attached together before, during, or after any point during the construction of the non-centerfire primer assembly. The powder charge may be of a type and amount sufficient for lethal or less-lethal purposes. Depending on the desired application of the cartridge, a lethal or less-lethal projectile is attached to enclosed within the casing (block 506).

Figure 19:
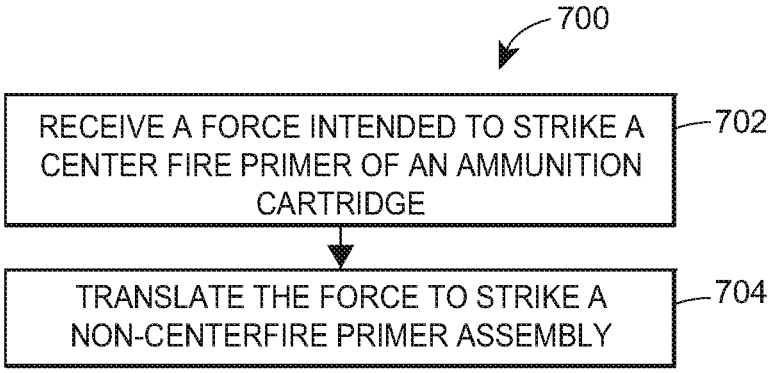
FIG. 19 is an example method of converting a centerfire firing device to a non-centerfire firing device using the offset firing pin assembly of the present invention as described herein.

FIG. 19 is a flow diagram of an example method for translating a force received from a centerfire firing device to a cartridge including a non-centerfire propellant assembly. The method 700 includes an offset firing pin assembly receiving an impact from a centerfire trigger assembly (block 702). The offset firing pin assembly includes an offset retainer having a first end and a second end, and an opening that extends through the offset retainer to the first and second ends. The firing pin is disposed within the opening and capable of extending beyond the first and second ends of the offset retainer, wherein in response to the firing pin receiving an impact force by the trigger assembly, the firing pin is configured to transfer the received force to impact the non-centerfire cartridge when loaded in battery position and in response to actuation of the trigger assembly. In other words, the offset firing pin assembly receives a force intended and or directed to be applied along the longitudinal axis of the loaded cartridge and translates the axial force to impact the cartridge off its longitudinal axis and onto the non-centerfire primer assembly that is coaxially positioned about the longitudinal axis.

Figure 20:
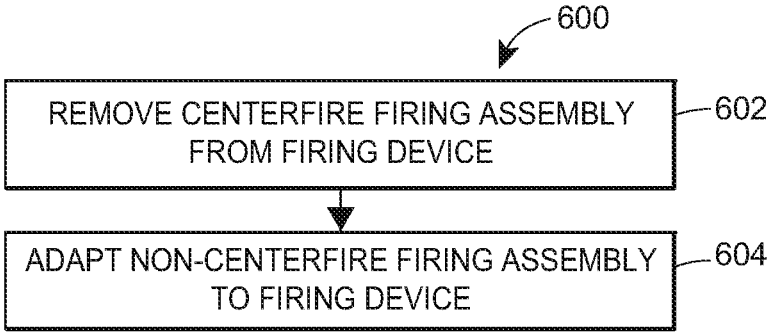
FIG. 20 is an example method for converting a centerfire firing device to a non-centerfire firing device using the offset firing pin assembly of the present invention as described herein.

FIG. 20 is a flow diagram of an example method for converting a centerfire firing device to a non-centerfire firing device using an embodiment of the present invention directed to an offset firing pin assembly. The method 600 includes removing the centerfire firing pin assembly from the firing device (block 602). An offset (non-centerfire) fire pin assembly is then stalled within the firing device in place of the centerfire firing pin assembly (block 604). The offset retainer includes a first end, a second end, and an opening extending through the offset retainer to the first and second ends. The firing pin is disposed within the opening and capable of extending beyond the first and second ends of the offset retainer, wherein in response to the firing pin receiving an impact force by the trigger assembly, the firing pin is configured to transfer the received force to impact the non-centerfire cartridge when loaded in battery position and in response to actuation of the trigger assembly.

It can be readily observed that the non-centerfire primer assembly, for example, the annulus incendiary portion, includes a primer compound surrounding an inert portion that is absent the primer compound and/or any other type of incendiary matter. In other words, the non-centerfire primer assembly is absent any structure that is capable of facilitating an explosion of the primer compound and further igniting the propellant or powder charge in response to an impact received from a striker of a firing device near the center of the base of the cartridge casing. In addition, the non-centerfire primer assembly is absent any structure that is capable of facilitating an explosion of the primer compound and further igniting the propellant or powder charge in response to an impact received from a striker of a firing device near the perimeter of the base of cartridge casing. Therefore, a lethal cartridge implementing a rimfire or centerfire primer is incapable of being fired from a less-lethal firing device implementing the offset firing pin assembly described herein. Similarly, a cartridge implementing the non-centerfire primer assembly of the present invention is not able to be fired from a conventional firing device with a conventional centerfire or rimfire firing mechanism.

It is to be understood that the size of the cartridge and/or firing assembly described herein is dependent upon the manufacturer. For example, the cartridge and/or bolt-carrier assembly may be sized for use with any standard cartridge size, type (e.g., bullet, shotshell, canister), and/or gauge, e.g., 10 ga, 12 ga, 20 ga, 28 ga, high brass and/or low brass loads. In addition, the projectile of the cartridge may be of any size and/or type, e.g., less lethal non-metal shot and/or slugs, bean bags.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "operatively coupled" and "operatively connected" along with their derivatives. For example, some embodiments may be described using the term "operatively coupled" to indicate that two or more elements are in direct physical contact. The term "operatively coupled," however, may also mean that two or more elements are not in direct contact with each other, but yet still cooperate or interact with each other in an operative manner. The embodiments are not limited in this context.

Additionally, some embodiments may be described using the expression "cooperative," cooperative operation" and "operative cooperation" along with their derivatives. For example, some embodiments may be described using the term "operatively cooperative" to indicate that two or more elements are coupled and cooperate in an manner to achieve an intended effect, as expected.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

Although the preceding text sets forth a detailed description of numerous different embodiments, it should be understood that the legal scope of the invention is defined by the words of the claims set forth at the end of this patent. The detailed description is to be construed as example only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence, "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Moreover, although the foregoing text sets forth a detailed description of numerous different embodiments, it should be understood that the scope of the patent is defined by the words of the claims set forth at the end of this patent. The detailed description is to be construed as exemplary only and does not describe every possible embodiment because describing every possible embodiment would be impractical, if not impossible. Numerous alternative embodiments could be implemented, using either current technology or technology developed after the filing date of this patent, which would still fall within the scope of the claims. By way of example, and not limitation, the disclosure herein contemplates at least the following aspects:

Aspect 1: A cartridge for cooperative operation with a non-centerfire firing device having an offset firing pin assembly, the cartridge comprising a cylindrical casing including a case head proximate a first end, a hull proximate a second end, and an interior disposed within the casing between the first end and the second end; a non-centerfire propellant assembly including a non-centerfire primer assembly operatively positioned near a propellant charge; a recess defined within the case head and including an opening centrally located proximate the first end of the case head for receiving the non-centerfire primer assembly, the non-centerfire primer assembly located within the opening and including an annulus incendiary portion coaxially aligned with the casing, the annulus incendiary portion surrounding an inert portion centrally located within the first end of the case head, wherein the annulus incendiary portion includes a primer compound and the inert portion is absent the primer compound; and a projectile affixed to and/or within the hull proximate the second end of the casing, wherein the propellant charge is capable of being ignited when the cartridge is loaded within the non-centerfire firearm and the annulus incendiary portion of the non-centerfire primer assembly is struck by the offset firing pin assembly.

Aspect 2: The cartridge of aspect 1, further comprising a space within the case head and surrounding the annulus incendiary portion of the non-centerfire primer assembly to facilitate deforming the annulus incendiary portion of the non-centerfire primer assembly in response to the striking by offset firing pin assembly.

Aspect 3: The cartridge of aspect 1, further comprising a propellant charge case, wherein the propellant charge is retained with the propellant charge case and the non-centerfire propellant assembly is disposed within the propellant charge case.

Aspect 4: The cartridge of aspect 3, further comprising a space within the case head and surrounding the annulus incendiary portion of the non-centerfire primer assembly to facilitate deforming the annulus incendiary portion of the non-centerfire primer assembly in response to the striking by offset firing pin assembly.

Aspect 5: The cartridge of any one of aspects 1-4, wherein the casing includes aluminum.

Aspect 6: The cartridge of any one of aspects 1-5, wherein the hull is integral with and extends from the case head.

Aspect 7: The cartridge of any one of aspects 1-6, wherein the case head is attached to the hull.

Aspect 8: The cartridge of any one of aspects 1-7, wherein the projectile includes a less-lethal material including non-metal, polymer, or rubber.

Aspect 9: The cartridge of any one of aspects 1-8, wherein the projectile extends beyond the second end of the casing.

Aspect 10: The cartridge of any one of aspects 1-9, wherein a dimension of the casing includes 37 mm, 40 mm, or any gauge cartridge.

Aspect 11: The cartridge of any one of aspects 1-10, wherein the casing includes an exterior surface including a visible and/or tangible identifier indicating less-lethal capability.

Aspect 12: The cartridge of any one of aspects 1-11, wherein the identifier includes any of the following: color, symbol, and textured pattern.

Aspect 13: An offset firing pin assembly for facilitating use of a non-centerfire cartridge including a non-centerfire propellant assembly with a firing device having a centerfire or rimfire trigger assembly, the offset firing pin assembly comprising: an offset retainer including a first end and a second end; an opening extending through the offset retainer to the first and second ends; a firing pin disposed within the opening and capable of extending beyond the first and second ends of the offset retainer, wherein in response to the firing pin receiving an impact force by the trigger assembly, the firing pin is configured to transfer the received force to impact the non-centerfire propellant assembly of the non-centerfire cartridge when loaded in battery position of the firing device and in response to actuation of the trigger assembly.

Aspect 14: The offset pin assembly of aspect 13, wherein the opening extending through the offset retainer to the first and second ends is diagonal.

Aspect 15: A method of manufacturing a less-lethal non-centerfire cartridge for use with a mechanical firing device including a non-centerfire firing system, the method comprising: providing a cartridge including a casing and a case head; adapting a non-centerfire propellant assembly to the case head; disposing a projectile within the casing.

Aspect 16: The method of aspect 15, wherein adapting a non-centerfire propellant assembly includes: providing a non-centerfire priming assembly including an annular incendiary portion including a primer compound positioned about an inert portion absent the primer compound; and inserting the non-centerfire primer assembly into the case head for cooperation with the firing device.

Aspect 17: The method of any one of aspects 15-16, wherein adapting a non-centerfire propellant assembly includes: providing a non-centerfire priming assembly including a non-centerfire primer assembly and a propellant charge case, the non-centerfire priming assembly including an annular incendiary portion having a primer compound positioned about an inert portion absent the primer compound, and the propellant charge case including a propellant charge disposed within and an opening for receiving the non-centerfire primer assembly; inserting the non-centerfire primer assembly into the opening of the propellant charge case to form the propellant charge case; and inserting the non-centerfire primer assembly into the case head for cooperation with the firing device.

Aspect 18: A method for configuring a centerfire firing device to a non-centerfire device for firing a non-centerfire cartridge, the centerfire firing device including a trigger assembly and centerfire firing pin assembly for striking a centerfire cartridge, the method comprising: removing the centerfire firing pin assembly from the centerfire firing device; and installing an offset firing pin assembly into the centerfire firing device.

Aspect 19: The method of aspect 18, wherein the offset firing pin assembly comprises: an offset retainer including a first end and a second end; an opening extending through the offset retainer to the first and second ends; a firing pin disposed within the opening and capable of extending beyond the first and second ends of the offset retainer, wherein in response to the firing pin receiving an impact force by the trigger assembly, the firing pin is configured to transfer the received force to impact the non-centerfire cartridge when loaded in battery position and in response to actuation of the trigger assembly.

What is claimed:

1. A method for configuring a centerfire firing device to a non-centerfire device for firing a non-centerfire cartridge, the centerfire firing device including a trigger assembly and a slidable centerfire firing pin assembly for striking a centerfire cartridge, the method comprising:

removing the centerfire firing pin assembly from the centerfire firing device; and installing an offset firing pin assembly into the centerfire firing device, wherein the offset firing pin assembly includes:

an offset retainer including a first end and a second end;

an opening extending through the offset retainer to the first and second ends;

an offset firing pin disposed within the opening and capable of extending beyond the first and second ends of the offset retainer; and a biasing component configured to bias the offset firing pin toward the first end of the offset retainer, wherein in response to the offset firing pin receiving an impact force by the trigger assembly, the offset firing pin is configured to transfer the received force to impact the non-centerfire cartridge when loaded in battery position and in response to actuation of the trigger assembly.

2. The method of claim 1, wherein the offset retainer includes a longitudinal axis that is coaxial with the cartridge when loaded in the firing device, and the opening extending through the offset retainer is diagonal within the offset retainer and not parallel with the longitudinal axis of the offset retainer.

3. The method of claim 1, wherein removing the centerfire firing pin assembly from the centerfire firing device includes removing a retainer including a centerfire firing pin from the centerfire firing device, the retainer including:

a first end and a second end;

an opening extending through the retainer to the first and second ends;

the centerfire firing pin disposed within the opening and capable of extending beyond the first and second ends of the retainer, wherein in response to the centerfire firing pin receiving an impact force by the trigger assembly, the centerfire firing pin is configured to transfer the received force to impact the centerfire cartridge when loaded in battery position and in response to actuation of the trigger assembly.

4. The method of claim 1, wherein the biasing component includes a spring coupled to the firing pin .

5. The method of claim 4, wherein the spring includes a coiled spring or a leaf spring.

6. The method of claim 4, wherein the spring is disposed within the opening.

7. An offset bolt for configuring a centerfire firing device to a non-centerfire device for firing a non-centerfire cartridge having an annular primer at its end and disposed between its center and perimeter, the centerfire firing device including a trigger assembly and a slidable centerfire bolt including a centerfire firing pin for striking a centerfire cartridge, the offset bolt comprising:

an offset retainer including a first end and a second end;

an opening extending through the offset retainer to the first and second ends;

an offset firing pin disposed within the opening and capable of extending beyond the first and second ends of the offset retainer; and a biasing component configured to bias the offset firing pin toward the first end of the offset retainer, wherein in response to the offset firing pin receiving an impact force by the trigger assembly, the offset firing pin is configured to transfer the received force to impact the non-centerfire cartridge when loaded in battery position and in response to actuation of the trigger assembly.

8. The offset bolt of claim 7, wherein the offset retainer includes a longitudinal axis that is coaxial with the non-centerfire cartridge when loaded in the firing device, and the opening extending through the offset retainer is diagonal within the offset retainer and not parallel with the longitudinal axis of the offset retainer.

9. The offset bolt of claim 7, wherein the biasing component includes a spring coupled to the firing pin.

10. The offset bolt of claim 9, wherein the spring includes a coiled spring or a leaf spring.

11. The offset bolt of claim 9, wherein the spring is disposed within the opening.

12. The offset bolt of claim 7, further comprising a collar radially extending from the firing pin.

13. The offset bolt of claim 12, wherein the collar is integral with the firing pin.

14. The offset bolt of claim 12, wherein the collar is affixed to the firing pin.

15. The offset bolt of claim 7, wherein the spring is disposed within the opening.

16. The offset bolt of claim 7, further comprising a retainer disposed within the opening and securing the firing pin and biasing component within the opening.

* * * * *